United States Patent [19]

Gill

[11] 4,324,753

[45] Apr. 13, 1982

[54] METHOD OF PRODUCING AN AIR LAID PAPER WEB UTILIZING MICROENCAPSULATED HYDROGEN BOND PROMOTING MATERIAL

[76] Inventor: Robert A. Gill, 7452 Red Coat Dr., Hamilton, Ohio 45011

[21] Appl. No.: 203,070

[22] Filed: Nov. 3, 1980

[51] Int. Cl.[3] ..... B27J 5/00

[52] U.S. Cl. ..... 264/121; 264/122; 264/518

[58] Field of Search ..... 264/518, 101, 115, 121, 264/122

[56] References Cited

U.S. PATENT DOCUMENTS 4,083,913 4/1978 Marshall ..... 264/122

4,112,037 9/1978 Parker et al. ..... 264/122

4,264,290 4/1981 Dunkerly ..... 264/121

*Primary Examiner*—James R. Hall

*Attorney, Agent, or Firm*—Evelyn M. Sommer

[57] ABSTRACT

A method of forming an air laid web of hydrogen bonded wood pulp fibers is disclosed. More specifically, a paper producing method is disclosed wherein microencapsulated hydrogen bond promoting material is thoroughly premixed with wood pulp fibers. The mixture is then air laid on a moving screen to form a three dimensional continuum. The microcapsules may then be ruptured by heat and/or pressure to release the hydrogen bond promoting material evenly throughout the continuum. The continuum may then be heated or pressed to further consolidate the web.

12 Claims, 1 Drawing Figure

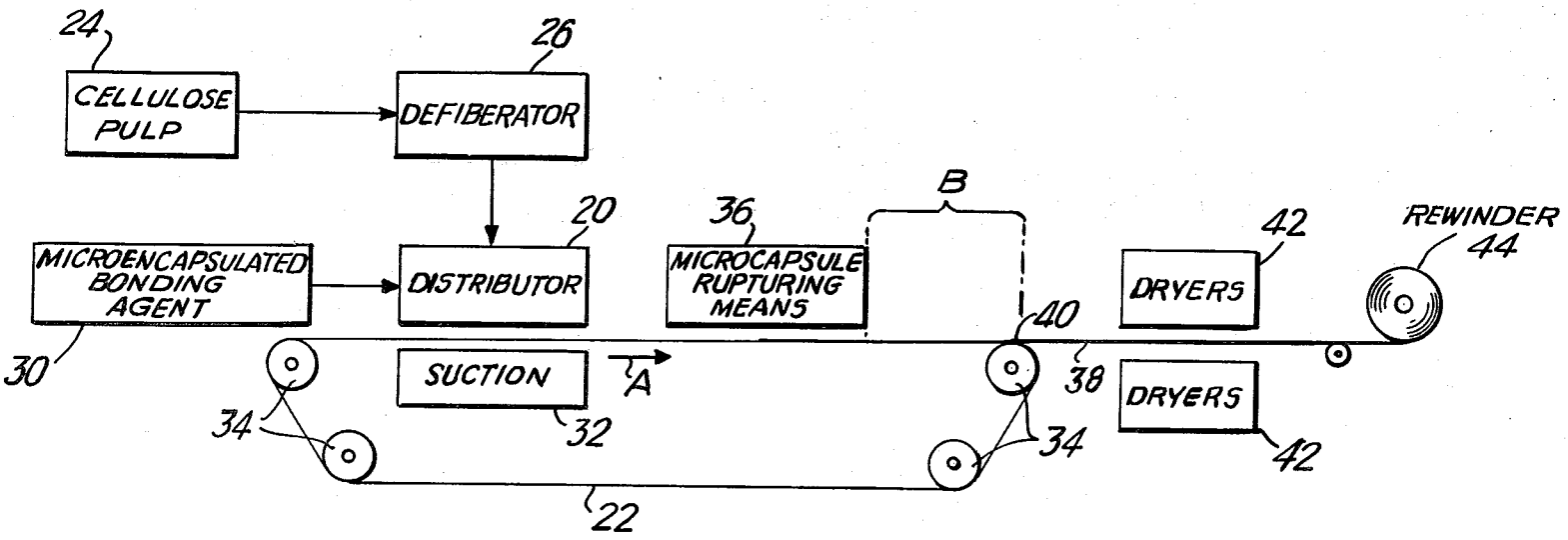
REWINDER
44
42
DRYERS
42
DRYERS
38
40
34
B
MICROCAPSULE RUPTURING MEANS
36
A
22
26
DEFIBERATOR
20
DISTRIBUTOR
SUCTION
32
34
CELLULOSE PULP
24
MICROENCAPSULATED BONDING AGENT
30

METHOD OF PRODUCING AN AIR LAID PAPER WEB UTILIZING MICROENCAPSULATED HYDROGEN BOND PROMOTING MATERIAL

BACKGROUND OF THE INVENTION

The subject invention relates to a new and improved method for producing an air laid web of hydrogen bonded wood pulp fibers. More particularly, microencapsulated hydrogen bond promoting material is evenly dispersed with wood pulp fibers prior to air laying the mixture on a moving screen. Thereafter, the microcapsules are ruptured enabling hydrogen bonds to form between the wood fibers to produce a consolidated web.

The most widely used prior art methods for forming paper include the production of a slurry which is a combination of wood pulp fibers and water, having a water to fiber ratio in the range of 200 to 1 to 1,000 to 1. In this procedure, the slurry is laid out on a moving screen and suction is used to draw out a portion of the water. Thereafter, rollers are employed in conjunction with various blotting devices in order to squeeze out and remove additional water to produce the final paper product. In this procedure, the presence of water in the slurry is sufficient to produce bonding between the fibers. More specifically, it has been found that wood fibers in the presence of water will form hydrogen bonds between the OH groups of the cellulose molecules in the wood. The resulting paper product, in which the pulp fibers are held together merely by hydrogen bonding, has sufficient strength to be used in a wide variety of applications.

A major shortcoming of the "water laden" processes is that large quantities of water are required to manufacture paper by these techniques. The large quantities of water require very high capital investments per ton of product, severely restricting usable plant locations and in addition, increasing the likelihood of water pollution.

Accordingly, there has recently been developed in the prior art various "dry forming" processes for producing paper without using high volumes of water. In these processes, fibers are air circulated and blown or drawn onto a moving screen to form a three dimensional continuum which then may be pressed into paper. Since there is no slurry to provide the water to form the hydrogen bonding for web consolidation, other means must be provided to consolidate the continuum. For example, when producing high strength paper, such as those used for shipping bags, it has been found that various resins which are sprayed on the surfaces of the paper have an adhesive effect which stabilizes and bonds the web. However, in most paper forming applications, it is unncessary to achieve the high strength produced by using resins. Since the use of resins is relatively expensive, a number of prior art methods have been developed wherein a hydrogen bond promoting material such as water or ammonia is in some way added to the web in order to allow hydrogen bonding to occur between the wood pulp fibers. However, relatively complex and expensive equipment such as spraying devices, are needed to carry out the latter prior art methods. Further, spraying techniques suffer from an additional disadvantage in that only the outer layers of the web are treated, thereby limiting dispersal throughout the web, making complete consolidation difficult to achieve.

One example of a prior art dry forming process can be found in U.S. Pat. No. 3,838,000 issued Sept. 24, 1974 to Urbas. In Urbas there is disclosed a method of producing a dry formed paper product wherein a relatively complex misting chamber is provided in order to spray the surfaces of the web. Another example can be found in U.S. Pat. No. 3,949,035 issued Apr. 6, 1976 to Dunning et al, wherein the surfaces of the moving web are treated with water to induce hydrogren bonding therein. As noted above, both these methods suffer from the disadvantage that water is sprayed only onto the opposed surfaces of the web making complete distribution of the hydrogen bonding throughout the web difficult to achieve.

Another example of a prior art dry forming paper process can be found in U.S. Pat. No. 3,906,064 issued Sept. 16, 1975 to Iannazzi et al. In the latter patent, complex apparatus is disclosed wherein wood pulp fibers are jetted around a conduit in the presence of high humidity in an attempt to disperse moisture through the fibers, prior to their being laid on a moving screen. As can be appreciated, the complex conduit and blowing system disclosed in Iannazzi is relatively complex and therefore expensive.

Accordingly, it is an object of the subject invention to provide a new and improved method of producing an air laid web of wood pulp fibers wherein hydrogen bonding is achieved throughout the entire web.

It is another object of the subject invention to provide a new and improved method for producing an air laid web which is simple and relatively inexpensive to carry out.

It is a further object of the subject invention to provide a new and improved method of producing an air laid web of hydrogen bonded wood pulp fibers wherein micro-encapsulated hydrogen bonding material such as water is evenly distributed with the wood pulp fibers prior to their air laying on a moving screen. The microcapsules are subsequently ruptured to produce a hydrogen bonded web.

SUMMARY OF THE INVENTION

In accordance with these and many other objects, the subject invention provides for a method of producing an air laid web having hydrogen bonds consolidating the wood pulp fibers. More specifically, microencapsulated hydrogen bond promoting material is combined with the wood pulp fibers prior to the mixture being air laid on a moving screen. The hydrogen bonding material, which can be for example, water, or ammonia, is encapsulated in a thermoplastic or pressure sensitive polymer which is merely mixed with the wood pulp fibers by a suitable mechanical means. The wood pulp fibers are obtained from any conventional source. Thereafter, the mixture is air laid onto a moving screen, preferably with the aid of suction, to form a three dimensional continuum. The microcapsules are then ruptured by heat, pressure or a combination of both, in order to release the hydrogen bond promoting material contained therein. The released material will then permit fiber to fiber hydrogen bonding to occur, consolidating the web. Any further treatment of the web may then be carried out as desired in accordance with the particular paper application, such as further rolling and drying, to produce a paper having the desired qualities.

It is apparent that the subject method achieves the advantages of a dry forming process by eliminating extensive use of water with its inherent difficulties, and in addition overcomes the shortcomings of the prior art dry forming processes by eliminating the costly and complex mechanical expedients necessary to add water to the moving web. In addition, in a relatively simple manner, the subject method permits the premixing and complete dispersion of the microcapsules throughout the wood pulp fibers to insure complete consolidation of the web.

In sharp contrast to the dry forming process of the subject invention, it is noted that in U.S. Pat. No. 3,556,934 which issued Jan. 19, 1971 to Meyer, disclosed the use of expandable thermoplastic microspheres which are added to a pulp slurry in a liquid forming process. In this liquid forming process, the pulp slurry is heated allowing the gas in the microspheres to expand. The expanded microspheres function to add bulk to the paper formed by this "water laden" process.

Other objects and advantages of the subject invention will become apparent from the following detailed description when taken in conjunction with the drawing in which:

BRIEF DESCRIPTION OF THE DRAWING

The sole FIGURE is a schematic view illustrating the steps of the new and improved method of producing an air laid web of hydrogen bonded wood pulp fibers of the subject invention.

DESCRIPTION OF THE PREFERRED EMBODIMENT

Referring to the sole FIGURE. there is illustrated schematic diagram depicting a dry forming process in accordance with the subject invention. More specifically, wood pulp fibers are introduced into a distributor 20 which is generally a mechanical-electrical device wherein pulp fibers are spun and airblown to form in effect, a suspension, prior to being laid out on a moving screen 22. The wood pulp fibers may be obtained by any method well known in the art. As illustrated in the FIGURE, cellulose pulp 24, from a source such as used paper products, are introduced into a difiberator 26 which functions to strip the pulp into tiny fibers suitable for an air laying process. The wood pulp fibers from the defiberator 26 are then introduced to the distributor 20.

In accordance with the subject invention, microencapsulated bonding agents 30 are introduced into the distributor 20 prior to the mixture being deposited on the moving screen 22. Suitable bonding agents are those which provide a source of hydrogen and are preferably relatively inexpensive such as water or ammonia. The hydrogen bonding agent 30 is encapsulated with a polymeric substance which is either heat and/or pressure sensitive. It is intended that the microcapsules be ruptured by either heat and/or pressure with the selection of the particular means being related to the desired end properties of the paper. The particular polymeric susbstance used to encapsulate the hydrogen bond promoter may be inert to the paper making process or, in the alternative, may be a resin which will promote adhesive-type bonding in addition to the hydrogen bonding achieved by the bonding agent.

One of the unique advantages of the subject invention is that the microencapsulated bonding agent 30 can be completely and thoroughly dispersed in the distributor with the wood pulp fibers. By ths arrangement, complete consolidation of the web throughout its thickness may be achieved thereby increasing desirable qualities such as strength. After the microencapsulated bonding agent is fully dispersed with the wood pulp fibers, it is air laid onto a moving screen 22 in a manner similar to the dry forming process used in the prior art. Preferably, the air laying is facilitated by providing a suction device 32 disposed directly below the distributor which provides a negative pressure underneath the screen 22 to aid in the laying of the fibers therein.

In a continuously run dry forming process, a continuum of material, consisting of the wood pulp fibers in combination with the microencapsulated bonding agents, is laid out on the moving screen. The screen 22 which may be entrained around pulleys 34 moves in a direction as indicated by arrow A, bringing the continuum to the microcapsule rupturing means 36. The means for rupturing the microcapsules may be either heat, pressure or both. If the microcapsules are heat sensitive, a heating means may be provided which will cause the outer covering of the capsules to rupture. In the alternative, if the microcapsules are pressure sensitive, pinch rollers may be provided which function to rupture the outer covering of the microcapsules releasing the hydrogen bonding agent throughout the continuum. The selection of the rupturing means is dependent on the desired qualities of the paper, and the type of microencapsulating material.

The web is then transported along the screen 22 through a distance "B" during which time the hydrogen bonds are formed within the web. Depending upon the particular bonding agent, the type of pulp fiber utilized, and other variables, the distance B is adjusted to provide the necessary amount of consolidation for the desired application. Once the proper consolidation is achieved, the web 38 may be drawn off the end of the moving screen at point 40 and pulled through dryers 42 to complete the consolidation process. The paper web 38 may then be journaled and wound around rewinder 44 in large rolls which are convenient to transport and handle.

In summary, there is provided a new and improved method for producing an air laid web of hydrogen bonded wood pulp fibers wherein microencapsulated hydrogen bond promoting material is combined with the wood pulp fibers prior to their being air laid on a moving screen. The continuum formed on the moving screen is subjected to heat and/or pressure to rupture the microcapsules thereby releasing the hydrogen bond promoting material. By this arrangement, hydrogen bonds are formed between the cellulose pulp material to produce a consolidated paper product.

As is apparent from the foregoing specification, the present invention may be embodied with various alterations and modifications which may differ from those that have been described in the preceding specification. For this reason, it is to be fully understood that all the foregoing is intended to be merely illustrative, and is not to be construed or interpreted as being restrictive or otherwise limiting of the present invention as defined by the appended claims. For example, it is intended to be within the scope of the subject invention to provide additional water to the distributor or to the moving web in the form of sprays or other expedients to further enhance consolidation.

What is claimed is:

1. A method of producing a web of hydrogen-bonded wood pulp fibers comprising the steps of:

forming a suspension of wood pulp fibers in air;

mixing a hydrogen-bond promoting agent in the form of microcapsules into said suspension;

depositing the wood pulp and microcapsule mixture on a moving screen to form a continuous web; and rupturing said microcapsules to release said bonding agent so that hydrogen-bonds are formed between said wood pulp fibers within said web.

2. The method of claim 1 wherein after said microcapsules are ruptured, said wood fibers are permitted to consolidate for a predetermined time period.

3. The method of claim 2 further comprising the step of heating said web to dry and further consolidate said wood pulp fibers.

4. The method of claim 1 wherein said hydrogen-bond promoting agent is encapsulated in a polymer which ruptures under pressure and said rupturing step includes applying pressure to said web to rupture said microcapsules.

5. The method of claim 4 wherein said pressure is exerted by rollers.

6. The method of claim 1 wherein said hydrogen-bond promoting agent is encapsulated in a thermoplastic material and said rupturing step comprises heating said web to rupture said microcapsules.

7. The method of claim 1 wherein said wood pulp fibers are manufactured from cellulose pulp which is stripped into said fibers in a defiberator.

8. The method of claim 1 wherein said suspension of wood pulp fibers in air is formed in a distributor which spins said fibers and blows them with air.

9. The method of claim 8 wherein said microcapsules are introduced to said suspension while said suspension is in said distributor.

10. The method of claim 1 wherein the depositing of the wood pulp and microcapsules on said moving screen is facilitated by providing suction through said screen.

11. The method of claim 1 wherein said hydrogen-bond promoting agent is water.

12. The method of claim 1 wherein said hydrogen-bond promoting agent is ammonia.

* * * * *